US009294861B2

(12) United States Patent
Katayama

(10) Patent No.: US 9,294,861 B2
(45) Date of Patent: Mar. 22, 2016

(54) AUDIO SIGNAL PROCESSING DEVICE

(71) Applicant: YAMAHA CORPORATION, Hamamatsu-shi, Shizuoka-ken (JP)

(72) Inventor: Masaki Katayama, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 298 days.

(21) Appl. No.: 13/846,081

(22) Filed: Mar. 18, 2013

(65) Prior Publication Data

US 2013/0251156 A1 Sep. 26, 2013

(30) Foreign Application Priority Data

Mar. 23, 2012 (JP) ..... 2012-068069

(51) Int. Cl.
*H04S 5/00* (2006.01)
*H04S 3/00* (2006.01)

(52) U.S. Cl.
CPC ... *H04S 5/00* (2013.01); *H04S 3/00* (2013.01); *H04S 5/005* (2013.01); *H04S 2400/07* (2013.01)

(58) Field of Classification Search
CPC ..... H04S 5/00; H04S 3/00; H04S 2420/07; H04S 2400/01; H04S 5/005; H04S 2400/07; H04R 1/26
See application file for complete search history.

(56) References Cited

U.S. PATENT DOCUMENTS

RE42,390 E * 5/2011 Hosoi et al. ..... 381/307
2005/0220312 A1* 10/2005 Kasai et al. ..... 381/1
2006/0266202 A1* 11/2006 Elmedyb et al. ..... 84/661

FOREIGN PATENT DOCUMENTS

JP 08-256400 A 10/1996
JP 4655098 B 1/2011

* cited by examiner

*Primary Examiner* — Ping Lee
(74) *Attorney, Agent, or Firm* — Rossi, Kimms & McDowell LLP

(57) ABSTRACT

A postprocessor mixes audio signals for an LSch and an RSch indicating virtual surround sounds generated by a virtual surround processing unit with audio signals of an Rch, an Lch, and a Cch, performs a high-pass filter process, and then outputs the processed audio signals as audio signals for an Rsp and an Lsp which are main speakers. Further, the postprocessor performs phase inversion on the audio signals for the LSch and the RSch indicating the virtual surround sounds generated by the virtual surround processing unit, mixes the processed audio signals with audio signals of the Rch, the Lch, the Cch, and an LFEch, performs a low-pass filter process on the mixed signals, and then outputs the processed audio signals as audio signals for an SW which is a subwoofer. Thus, in a sound field realized by a virtual surround system, an influence of the sounds emitted from the subwoofer on localization of sounds of channels of virtual speakers is reduced.

6 Claims, 6 Drawing Sheets

AUDIO SIGNAL PROCESSING DEVICE

Priority is claimed on Japanese Patent Application No. 2012-68069, filed Mar. 23, 2012, the content of which is incorporated herein by reference.

BACKGROUND OF THE INVENTION

1. Technical Field

The present invention relates to a virtual surround technology.

2. Background Art

Surround systems realizing a sound field with greater ambiance by emitting sounds from a plurality of speakers disposed to surround the periphery of a listener according to audio signals of more than 2 channels (multi-channels) have proliferated.

As the number of channels of audio signals used in the surround systems, 5.1 channels including a front center channel (hereinafter referred to as a "Cch"), a low-frequency effect channel (hereinafter referred to as an "LFEch") for an audio signal including a considerable component of a low frequency band, a surround left channel (hereinafter referred to as an "LSch"), and a surround right channel (hereinafter referred to as an "RSch") in addition to a front left channel (hereinafter referred to as an "Lch") and a front right channel (hereinafter referred to as an "Rch") used in a normal stereo sound field are currently in wide use. Further, the LSch and the RSch are channels of audio signals emitted from the left rear side and the right rear side, respectively.

In recent years, to realize a more natural sound field, the number of channels of audio signals has tended to increase. Thus, for example, 7.1 channels in which two left and right channels for back surround are added to the rear side of the LSch and the RSch of 5.1 channels or 9.1 channels in which two left and right channels for front presence are added to the upper side of the Lch and the Rch of 7.1 channels are being proliferating.

The most orthodox method of realizing a sound field by audio signals of multi-channels is a method of disposing the number of speakers corresponding to the number of channels within a sound space and emitting sounds according to audio signals of the corresponding channels from the speakers. In the case of this method, it is necessary to dispose the multiple speakers within a sound space. Therefore, inconveniences and disadvantages such as high cost, necessity of a space for disposing the speakers, and necessity of connection of multiple cables for transmitting audio signals and supplying power may be caused.

To resolve or alleviate the above-mentioned inconveniences and disadvantages, numerous technologies for virtually obtaining surround effects have been suggested.

For example, Japanese Unexamined Patent Application, First Publication, No. H08-256400 has suggested a structure in which an improvement in the sense of surround is realized while keeping the sense of expansion of an environmental sound or a reverberant sound by generating audio signals of 2 pseudo-channels from a component of a middle frequency band of a Dolby surround signal having no surround information and adding audio signals obtained through phase-reversing the component of a low frequency band of an input signal to the audio signals.

For example, Japanese Patent No. 4655098 discloses a structure in which surround is realized without disposition of speakers on the lateral side or the rear side of a listener by emitting an acoustic beam having directivity from multiple speakers (a speaker array) arrayed on a plane to a wall surface so that an acoustic beam sound reflected from wall surface reaches the listener from the rear side or the lateral side of the listener.

In the structure disclosed in Japanese Patent No. 4655098, an improvement in the sense of surround of a sound of the low frequency band is designed by dividing components of the low frequency band of an input audio signal into a component with high correlation between channels and a component with low correlation between the channels, assigning directivity to the component with the high correlation so that a sound image can be localized in the middle of two left and right woofers, and assigning directivity to the component with the low correlation so that sound images can be localized to the left and right of the two left and right woofers, respectively.

In recent years, there has been a high need to miniaturize speakers used in surround systems. For example, with thinness and large screens of liquid crystal televisions, speakers included in the liquid crystal televisions or disposed under a rack on which the liquid crystal televisions are placed are preferred to be small due to space restrictions.

In widely used dynamic-type speakers, it is difficult to emit a sound of a low frequency band when the size of a vibration plate becomes small. Therefore, to emit the sound of the low frequency band rarely emitted by a mainly used speaker (hereinafter referred to as a "main speaker"), a subwoofer which is a speaker generally having a vibration plate with a size larger than the main speaker and an excellent sound emission capability in the low frequency band is additionally used in many cases.

Since the subwoofer generally has a size larger than that of the main speaker, a user may desire to dispose the subwoofer on the lateral side, the rear side, or the like of a room so that the subwoofer is not unsightly and obstructive. Therefore, wireless subwoofers that wirelessly receive an audio signal are also popular.

According to characteristics of human hearing, it is difficult to perceive localization of a sound of a low frequency band (for example, a band equal to or less than 100 Hz) compared to a sound of a high frequency band. Therefore, in the related art, a subwoofer having a role in emission of a sound of the low frequency band rarely influences localization of a sound in a realized sound field, regardless of a position in a sound space in which the subwoofer is arranged.

However, with the miniaturization of a main speaker, as described above, a frequency band at which the main speaker can emit a sound is narrowed to the high frequency side. Therefore, a bus management process is performed to emit a low frequency band which may not be emitted by the main speaker by complement of the subwoofer. Since the frequency band of a sound emitted from the subwoofer is spread to the high band through the bus management process, the localization of a sound of another channel may be influenced by the subwoofer.

For example, when the subwoofer conventionally having the role in the emission of a sound of a frequency band equal to or less than 100 Hz has a role in emission of a sound of a frequency band equal to or less than 500 Hz, a component of 100 Hz to 500 Hz frequency bands of a sound emitted from the subwoofer may influence the localization of a sound emitted from the main speaker, and thus the localization of the sound may be pulled in the direction of the subwoofer.

As described above, to resolve the inconveniences and disadvantages caused due to the disposition of multiple speakers when surround of multi-channels is realized, there is a need for a system that virtually realizes the surround of the multi-channels.

In the system (hereinafter referred to as a "virtual surround system") that virtually realizes the surround of the multi-channels, when listening to sounds emitted from fewer speakers than the number of channels, a listener perceives the sounds as if the listener were listening to sounds emitted from nonexistent virtual speakers. As a result, for example, a surround system of multi-channels such as 5.1 channels is virtually realized by a speaker system of 2.1 channels.

Hereinafter, an example of a surround system of 5.1 channels will be described. In a virtual surround system, localization of sounds emitted from virtual speakers, that is, an LSch speaker (hereinafter referred to as an "LSsp") and an RSch speaker (hereinafter referred to as an "RSsp") is realized using auditory psychology of a listener. Therefore, the localization of the sounds emitted from the virtual speakers is easily influenced by various external factors such as a positional relation between the speakers and the listener and the state of a sound reverberating from a wall, compared to sounds emitted from real speakers, that is an Lch speaker (hereinafter referred to as an "Lsp"), an Rch speaker (hereinafter referred to as an "Rsp"), and an LFEch subwoofer (hereinafter referred to as an "SW"). That is, the localization of the sounds of the LSch and the RSch is more unstable than the localization of the sounds of the Lch, the Rch, and the LFEch.

Since virtual process sounds, which are virtual sounds for processing the virtual sounds of the LSch and the RSch, are actually emitted from the physically existent Lsp and Rsp, a component of a low frequency band rarely emitted from the main speakers is required to be emitted from the SW. Accordingly, even in the virtual surround system, through the bus management process, the components of the low frequency band in the virtual process sounds of the LSch and the RSch are emitted together with the components of the low frequency band of the real sounds (sounds which the listener perceives and are emitted from the real Lsp and Rsp and emitted from the positions of the Lsp and the Rsp) of the Rch and the Lch and the sound from the LFEch from the SW.

When a main speaker used in a virtual surround system is small in size, an SW used in the virtual surround system is also required to emit sounds of 100 Hz to 500 Hz frequency bands of which the listener perceives the localization. As a result, the sounds of the LSch and the RSch that are perceived as components of the high frequency band are emitted from the virtual speakers, that is, the LSsp and the RSsp, and the component of the low frequency band is emitted from the real SW. In this case, there is the inconvenience that the localization of the LSch and the RSch may be influenced by the sound emitted from the SW, and thus may be pulled to the position of the SW.

SUMMARY OF THE INVENTION

The invention has been devised in light of the above-mentioned circumstances and an object of the invention is to reduce an influence of a sound emitted from a subwoofer on localization of a sound to be originally localized at the position of a virtual speaker in a sound field realized by a virtual surround system.

According to an aspect of the invention, an audio signal processing device is provided, including: a generation unit that processes at least one input audio signal to generate n (where n is a natural number equal to or greater than 2) virtual process audio signals indicating n virtual process sounds configured to process virtual sounds emitted from n speakers and perceived as sounds emitted from virtual speakers by a listener; a first output unit that outputs the n virtual process audio signals generated by the generation units to the n speakers; and a second output unit that outputs the n virtual process audio signals generated by the generation unit to a subwoofer. The first and second output units output the virtual process audio signals generated by the generation unit so as to have mutually opposite phases.

In the audio signal processing device, the phases of the sounds of the channels for the virtual speakers emitted from the main speakers and the sounds of the overlapping bands included in the sound of the same channel emitted from the subwoofer are opposite to each other. Therefore, the virtual sounds (including considerable components of a high frequency band) perceived as the sounds emitted from the virtual speakers by the listener and the virtual sounds (including considerable components of a low frequency band) emitted from the subwoofer are not combined, and thus the localization of the sounds of the channels for the virtual speakers is not pulled (moved) to the position of the subwoofer.

In the above-described audio signal processing device, at least one of the first and second output units may include an all-pass filter that rotates the phases so that the virtual process audio signals generated by the generation unit and respectively output from the first and second output units have the mutually opposite phases.

In the audio signal processing device, by adjusting a parameter (a rotation angle of a phase) of the all-pass filter, the phase of the virtual process audio signal output from the first output unit can be opposite to the phase of the virtual process audio signal output from the second output unit.

According to another aspect of the invention, an audio signal processing device is provided, including: a generation unit that processes at least one input audio signal to generate n (where n is a natural number equal to or greater than 2) virtual process audio signals indicating n virtual process sounds configured to process virtual sounds emitted from n speakers and perceived as sounds emitted from virtual speakers by a listener; a first output unit that outputs the n virtual process audio signals generated by the generation units to the n speakers; and a second output unit that outputs the n virtual process audio signals generated by the generation unit to a subwoofer. The second output unit outputs the virtual process audio signals generated by the generation unit by delaying the virtual process audio signals by a predetermined time from a timing at which the first output unit outputs the virtual process audio signals generated by the generation unit.

In the audio signal processing device, the sounds of the overlapping bands included in the sound of the same channel emitted from the subwoofer reach the listener later than the sounds of the channels for the virtual speakers emitted from the main speakers. Therefore, due to the precedence effect, the localization of the sounds is determined by the sounds of the channels for the virtual speakers emitted from the main speakers, and thus the localization of the sounds of the channels for the virtual speakers is not pulled (moved) to the position of the subwoofer.

In the above-described audio signal processing device, the first output unit may include a high-pass filter that attenuates a component of a frequency band lower than a predetermined cutoff frequency and included in the virtual process audio signals generated by the generation unit. The second output unit may include a low-pass filter that has the same order as the high-pass filter and attenuates a component of a frequency band greater than the predetermined cutoff frequency and included in the virtual process audio signals generated by the generation unit.

In the audio signal processing device, the audio signal which mainly includes only the component of the frequency band to be emitted by the main speakers and the subwoofer is input to each of the main speakers and the subwoofer. As a result, since distortion of the sound is reduced and the components of the virtual process sounds of the channels emitted in an overlapping manner from both the main speaker and the subwoofer are reduced, the localization of the channel for the virtual speaker is stabilized more.

In the above-described audio signal processing device, the first output unit may include a first mixing unit that receives n real audio signals indicating n real sounds emitted from the n speakers and mixes the n virtual process audio signals generated by the generation unit with the n real audio signals. The second output unit may include a second mixing unit that receives an audio signal indicating a sound emitted from the subwoofer and mixes the audio signal indicating the sound emitted from the subwoofer with the n virtual process audio signals generated by the generation unit.

In the audio signal processing device, the audio signal output from the first mixing unit is output to each of the n main speakers (or an amplifier or the like outputting the audio signal to the main speaker) and the audio signal output from the second mixing unit is output to the subwoofer (an amplifier or the like outputting the audio signal to the subwoofer). Therefore, a virtual surround system having the above-described advantages is realized.

DETAILED DESCRIPTION OF EMBODIMENTS

[Related Art]

Figure 5:
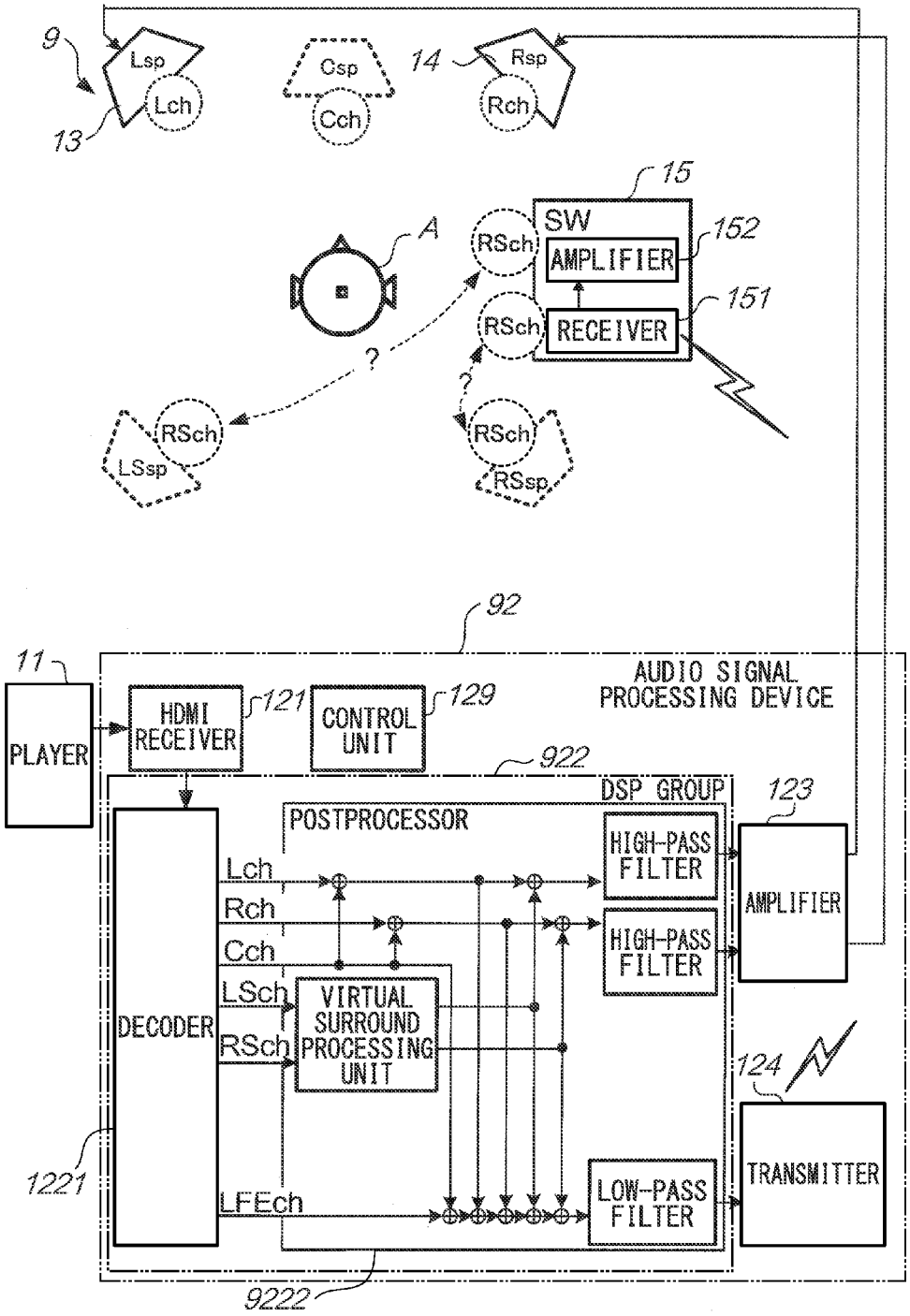
FIG. 5 is a diagram illustrating the configuration of a virtual surround system according to a related art.

Before describing a virtual surround system 1 according to embodiments of the invention, a virtual surround system 9 according to the related art will be first described with reference to FIG. 5.

In the virtual surround system 9 according to the related art, first, a player 11 sequentially reads, from a recording medium, acoustic data indicating acoustic contents of 5.1 channels to be reproduced in a sound space in which the virtual surround system 9 is disposed, and then outputs the acoustic data to an audio signal processing device 92 in a format conforming to the High-Definition Multimedia Interface (HDMI) (registered trademark) standard.

An HDMI receiver 121 of the audio signal processing device 92 receives the acoustic data input from the player 11 and delivers a DSP group 922 of the audio signal processing device 92.

The DSP group 922 functions as a decoder 1221 and a postprocessor 9222 under the control of a control unit 129.

The decoder 1221 decodes the acoustic data delivered from the HDMI receiver 121 to generate audio signals of 5.1 channels, that is, 6 channels of an Lch, an Rch, a Cch, an LSch, an RSch, and an LFEch. The decoder 1221 delivers the generated audio signals to the postprocessor 9222.

The audio signals of the LSch and the RSch delivered to the postprocessor 9222 are converted into a virtual process audio signal indicating a virtual process sound for an LSsp which is a virtual speaker and a virtual process audio signal indicating a virtual process sound for an RSsp which is a virtual speaker in a virtual surround processing unit (generation unit). The virtual process sound for the LSsp refers to a sound which is actually emitted from each of an Lsp 13 and an Rsp 14, but is configured to process a virtual sound which is a sound of which localization is perceived at the position of the nonexistent LSsp by a listener A. Likewise, the virtual process sound for the RSsp refers to a sound which is actually emitted from each of the Lsp 13 and the Rsp 14, but is configured to process a virtual sound which is a sound of which localization is perceived at the position of the nonexistent RSsp by the listener A.

The virtual surround processing unit generates a virtual process audio signal by causing a binaural processing unit to perform binaural processing and causing a crosstalk cancellation processing unit to perform a crosstalk cancellation process on the audio signal of the LSch and the audio signal of the RSch delivered from the decoder 1221.

Hereinafter, an overview of a virtual surround process will be described in an example of the audio signal of the LSch.

First, the binaural processing unit generates an audio signal indicating a binaural processing sound for the left ear by convolving a head-related transfer function determined by the position of the LSsp and the position of the left ear of the listener A in the audio signal of the LSch. Likewise, the binaural processing unit generates an audio signal indicating a binaural processing sound for the right ear by convolving a head-related transfer function determined by the position of the LSsp and the position of the right ear of the listener A in the audio signal of the LSch.

When the listener A listens to the binaural processing sound for the left ear only with the left ear and the binaural processing sound for the right ear only with the right ear, the listener A can perceive a sound from the position of the LSsp due to a level difference, a time difference, and a frequency characteristic difference between the binaural processing sounds.

As described above, when the binaural processing sound for the left ear and the binaural processing sound for the right ear indicating the audio signals generated by the binaural processing unit are emitted from the Lsp 13 and the Rsp 14, the binaural processing sound for the left ear also arrives at the right ear and the binaural processing sound for the right ear also arrives at the left ear.

To cancel the unnecessary binaural processing sounds (crosstalk) arriving at the opposite ears, the crosstalk cancellation processing unit generates an audio signal indicating a sound mixed in the binaural processing sound for the right ear as an audio signal for the Lsp 13 by performing a process of cancelling the binaural processing sound for the left ear arriving at the right ear. Likewise, the crosstalk cancellation processing unit generates an audio signal indicating a sound mixed in the binaural processing sound for the left ear as an audio signal for the Rsp 14 by performing a process of cancelling the binaural processing sound for the right ear arriving at the left ear.

As described above, the audio signal for the Lsp 13 and the audio signal for the Rsp 14 generated by the crosstalk cancellation processing unit are virtual process audio signals of the LSch. The virtual surround processing unit generates virtual process audio signals of the RSch by also performing the same process on the audio signals of the RSch.

The virtual surround processing unit generates an audio signal indicating a sound obtained by mixing the sounds indicated by the audio signals for the Lsp 13 among the virtual process audio signals of the LSch and the virtual process audio signals of the RSch generated in this way, as audio signals of the LSch and the RSch for the Lsp 13. Likewise, the virtual surround processing unit generates an audio signal indicating a sound obtained by mixing the sounds indicated by the audio signals for the Rsp 14 among the virtual process audio signals of the LSch and the virtual process audio signals of the RSch generated in this way, as audio signals of the LSch and the RSch for the Rsp 14. The above-described processes are the processes performed by the virtual surround processing unit.

The postprocessor 9222 generates an audio signal indicating a sound from which a component of a low frequency band is attenuated by a high-pass filter (for example, a cutoff frequency is 500 Hz) by mixing the sounds indicated by the audio signals of the Lch and the Cch delivered from the decoder 1221 and the audio signals of the LSch and the RSch for the Lsp 13 generated by the virtual surround processing unit after performing necessary level adjustment. The audio signal generated in this way is an audio signal indicating a sound actually emitted from the Lsp 13.

Likewise, the postprocessor 9222 generates an audio signal indicating a sound, from which a component of a low frequency band is attenuated by a high-pass filter (for example, a cutoff frequency is 500 Hz), by mixing the sounds indicated by the audio signals of the Rch and the Cch delivered from the decoder 1221 and the audio signals of the LSch and the RSch for the Rsp 14 generated by the virtual surround processing unit after performing necessary level adjustment. The audio signal generated in this way is an audio signal indicating a sound actually emitted from the Rsp 14.

The postprocessor 9222 outputs the audio signals for the Lsp 13 and the Rsp 14 generated in this way to an amplifier 123. The amplifier 123 converts the audio signals (digital signals) into analog audio signals, amplifies the levels of the analog audio signals to speaker levels, and then outputs the amplified analog audio signals to the Lsp 13 and the Rsp 14, respectively. The Lsp 13 and the Rsp 14 emit sounds The postprocessor 9222 generates audio signals indicating sounds from which components of a low frequency band are attenuated by a low-pass filter (for example, a cutoff frequency is 500 Hz) by mixing the sounds indicated by the audio signals of the Lch, the Rch, and the Cch, and the LFEch delivered from the decoder 1221, the audio signals of the LSch and the RSch for the Lsp 13, and the audio signals of the LSch and RSch for the Rsp 14 generated by the virtual surround processing unit after performing necessary level adjustment. The audio signals generated in this way are audio signals indicating sounds actually emitted from the SW 15.

The postprocessor 9222 outputs the audio signals for the SW 15 generated in this way to a transmitter 124. The transmitter 124 wirelessly transmits the audio signals to a receiver 151 of the SW 15.

The receiver 151 of the SW 15 receives the audio signals transmitted from the transmitter 124 of the audio signal processing device 92. The SW 15 converts the received audio signals (digital signals) into analog audio signals, causes an amplifier 152 to amplify the levels of the analog audio signals into speaker levels, and then emits the sounds according to the analog audio signals.

As described above, the sounds emitted from the Lsp 13, the Rsp 14, and the SW 15 arrive at the right and left ears of the listener A. At this time, the listener A perceives the sounds emitted from the 3 real speakers (two main speakers and one subwoofer) as sounds emitted from a total of 5 speakers including 3 virtual speakers of the Csp (a virtual speaker that is disposed in the middle position of the Lsp 13 and the Rsp 14 and emits the sound of the Cch), the LSsp, and the RSsp in addition to the 2 real speakers of the Lsp and the Rsp.

Here, the sounds emitted from the SW 15 are collective sounds of the components of the low frequency band of the sounds to be originally emitted from the positions of the 5 speakers, excluding the audio signal of the LFEch. Therefore, as described above, when the SW 15 emits the sound of the frequency band greater than 100 Hz, there is the inconvenience that the localization of the sounds that should be originally perceived from the positions of the Lsp 13, the Rsp 14, the Csp, the LSsp, and the RSsp by the listener A may be pulled (moved) to the position of the SW 15, since the same signal with the same phase is included between the sounds emitted from the positions of the SW 15 and the other speakers.

At this time, since the sounds of the Lch and the Rch emitted from the actual Lsp 13 and Rsp 14 and the sound of the Cch which the listener A perceives as the sound emitted from the virtual Csp disposed between the Lsp 13 and the Rsp 14 are not the sounds generated through the virtual surround process, a sense of localization stronger than the sense of localization produced by the SW 15 due to the magnitude of the frequency is produced for the listener A. As a result, in regard to the sounds of the channels, the localization of the sounds perceived by the listener A is pulled to the position of the SW 15 less.

On the other hand, since the sounds of the LSch and the RSch that the listener A perceives as the sounds emitted from the virtual LSsp and RSsp are the sounds generated through the virtual surround process, the sense of localization is more unstable compared to the sounds emitted from the real speakers. For example, when the sense of localization at the positions of the LSsp and the RSsp is decreased, for example, due to deviation in the positions in the sound space of the listener A, the listener A may feel the localization of the sounds of the channels at the positions deviated in the direction of the SW 15. In FIG. 5, each dotted mark 0 given to a channel name indicates a position in the sound space from which the listener A perceives the localization of the sound of the channel illustrated by the channel name.

When the high-pass filter can completely cut the component of the frequency band equal to or less than the cutoff frequency and the low-pass filter can completely cut the component of the frequency band equal to or greater than the cutoff frequency in the above-described virtual surround system 9, the sounds emitted from the Lsp 13 and the Rsp 14 do not overlap the sounds emitted from the SW 15 in association with the respective sounds of the LSch and the RSch. The listener does not perceive the sounds as the sounds of the same channel, and thus the problem that the localization of the sounds of the LSch and the RSch is influenced by the position of the SW 15 does not occur.

Figure 6:
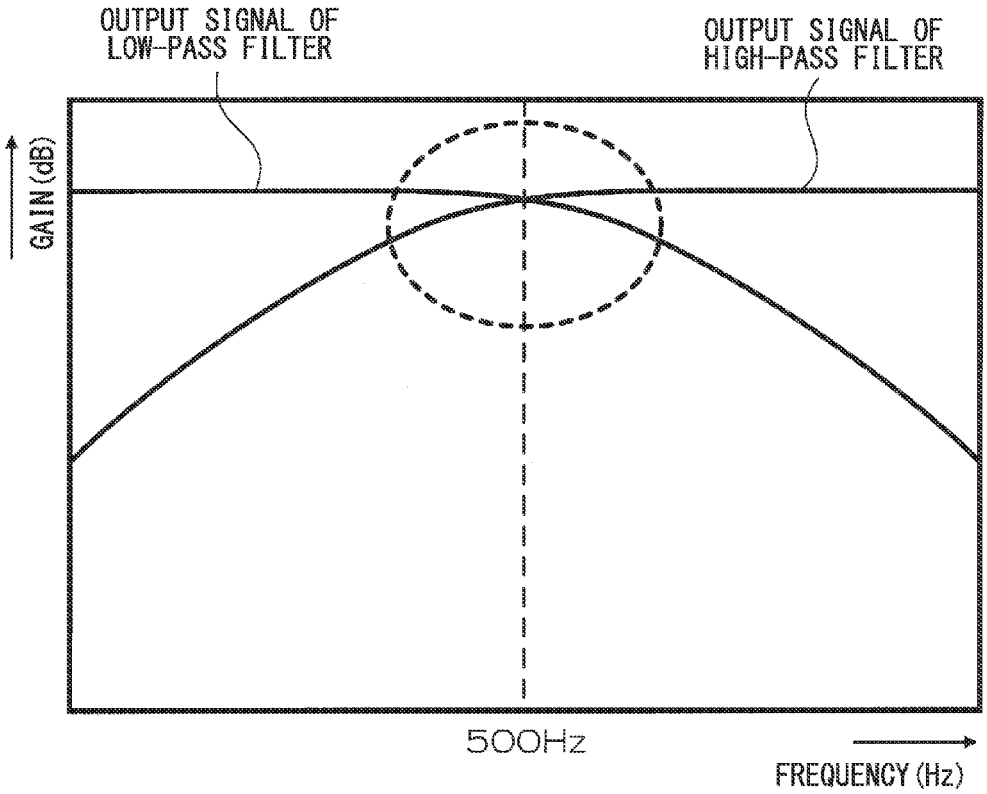
FIG. 6 is a graph illustrating frequency characteristics of output signals of a general high-pass filter and a general low-pass filter.

However, it is difficult to realize the ideal high-pass filter and low-pass filter described above. Although the ideal high-pass filter and low-pass filter can be realized, for example, inconvenience caused due to delay of the process may occur. Therefore, in practice, a high-pass filter and a low-pass filter that output sounds of frequency components schematically illustrated in FIG. 6 for an input of white noise are used. Further, when the Lsp 13 and the Rsp 14, and the SW 15 emit the same sounds of the same phase with mutually close levels in a frequency band indicated by a dotted circle of FIG. 6, the listener perceives the localization of the sounds of the respective channels from one position between the LSch and one position between the RSch and the SW 15 in association with the sounds of the LSch and the RSch.

As described above, in the virtual surround system 9 according to the related art, the inconvenience that the localization of the virtual speakers is pulled to the position of the SW 15 may easily occur.

[First Embodiment]

Figure 1:
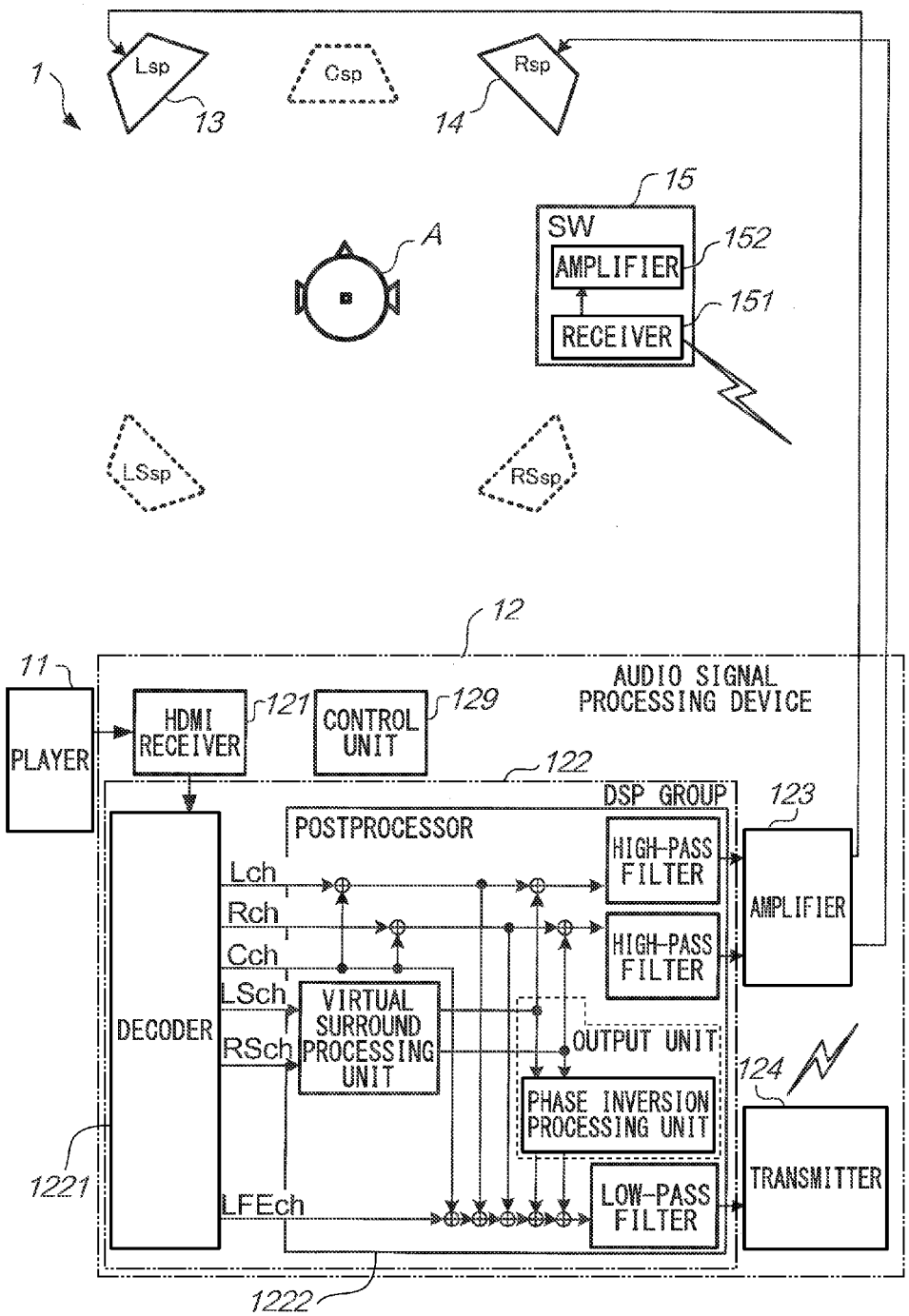
FIG. 1 is a diagram illustrating the configuration of a virtual surround system according to a first embodiment of the invention.

In a virtual surround system 1 according to a first embodiment of the present invention, the process of the postprocessor 9222 is modified to reduce the above-described inconvenience of the above-described virtual surround system 9. FIG. 1 is a diagram illustrating the configuration of the virtual surround system 1. In FIG. 1, the same reference numerals are given to the constituent units common to the units of the virtual surround system 9.

An audio signal processing device 12 of the virtual surround system 1 includes a postprocessor 1222 realized by a DSP group 122, instead of the postprocessor 9222 realized by the DSP group 922 of the audio signal processing device 92 of the virtual surround system 9. The postprocessor 1222 generates an audio signal indicating a sound from which a component of a low frequency band is attenuated by a low-pass filter (for example, a cutoff frequency is 500 Hz) by mixing sounds obtained by performing phase-inversion on signals indicated by audio signals of an Lch, an Rch, and a Cch delivered from a decoder 1221 as signals indicating the sounds actually emitted from the SW 15 and on signals indicated by audio signals of an LSch and an RSch for an Lsp 13 and audio signals of the LSch and the RSch for an Rsp 14 generated by a virtual surround processing unit, after performing necessary level adjustment.

More specifically, in the postprocessor 1222, a phase inversion processing unit inverts the phases of the audio signals of the LSch and the RSch for the Lsp 13 generated by the virtual surround processing unit. Likewise, in the postprocessor 1222, the phase inversion processing unit inverts the phases of the audio signals of the LSch and the RSch for the Rsp 14 generated by the virtual surround processing unit.

As described above, the audio signals of the LSch and the RSch for the Lsp 13 and the audio signals of the LSch and the RSch for the Rsp 14 subjected to the phase inversion by the phase inversion processing unit are mixed with the audio signals of the Lch, the Rch, the Cch, and the LFEch delivered from the decoder 1221. As a result, the audio signal for the SW 15 is generated.

Here, an important point is that the audio signals of the LSch and the RSch for the Lsp 13 and the audio signals of the LSch and the RSch for the Rsp 14 generated by the virtual surround processing unit are used without being subjected to the phase inversion in the generation of the audio signals for the Lsp 13 and the audio signals for the Rsp 14.

The orders of a high-pass filter and the low-pass filter of the postprocessor 1222 of the virtual surround system 1 are the same. Accordingly, the phases of the audio signals for the Lsp 13 and the Rsp 14 are not deviated from the phase of the audio signals for the SW 15.

As a result, the phases of the sounds of the LSch emitted from the Lsp 13 and the Rsp 14 are opposite to the phase of the sound of the LSch emitted from the SW 15. Likewise, the phases of the sounds of the RSch emitted from the Lsp 13 and the Rsp 14 are opposite to the phases of the sounds of the RSch emitted from the SW 15.

When the sound of the low frequency band of the LSch from the SW 15 is not emitted and the sounds of the high frequency band of the LSch are emitted from the Lsp 13 and the Rsp 14, a listener A perceives localization of the sound of the LSch at the position of the virtual LSsp. Further, when the sounds of the high frequency band of the LSch from the Lsp 13 and the Rsp 14 are not emitted and the sound of the low frequency band of the LSch is emitted from the SW 15, the emitted sound includes the component of the frequency band of 100 Hz to 500 Hz, and thus the listener A perceives localization of the sound of the LSch at the position of the SW 15. Accordingly, when the sounds of the high frequency band of the LSch from the Lsp 13 and the Rsp 14 and the sound of the low frequency band of the LSch from the SW 15 are emitted without performing such phase adjustment, the emitted sounds include the sounds of the overlapping bands, and thus the listener A perceives the combined sounds. As a result, as described with reference to FIG. 5, the localization of the sounds of the LSch may be pulled from the original position of the LSch to the position of the SW 15.

In the virtual surround system 1, however, the phases of the sounds of the LSch emitted from the Lsp 13 and the Rsp 14 are opposite to the phases of the sounds of the overlapping bands included in the sounds of the LSch emitted from the SW 15. Therefore, when the listener A perceives the sounds, the sounds are not combined. The listener A strongly perceives the localization of the sounds of the LSch by the sounds emitted from the Lsp 13 and the Rsp 14 and mainly including the component of the high frequency band and rarely perceives the localization of the sounds of the LSch by the sounds emitted from the SW 15 and mainly including the component of the low frequency band. As a result, the localization of the sounds of the LSch perceived by the listener A is not pulled to the position of the SW and are determined at the original position of the LSsp. The same also applies to the sounds of the RSch.

As a result, the localization of the sounds of the LSch and the RSch is stabilized at the original positions of the LSsp and the RSsp, and thus does not depend on the position of the SW 15.

As described above, in the virtual surround system 1, the localization of the virtually realized surround sounds is rarely influenced by the disposition position of a subwoofer, even when the subwoofer emits sounds including components of a frequency band (for example, a band equal to or greater than 100 Hz) that gives the sense of localization to a listener with miniaturization of main speakers in a virtual surround system of multi-channels. Therefore, the degree of freedom of the disposition position of the subwoofer in a sound space is improved.

The above-described virtual surround system 1 may be modified in various ways within the scope of the technical spirit of the invention. Such embodiments will be described below.

[Second Embodiment]

Figure 2:
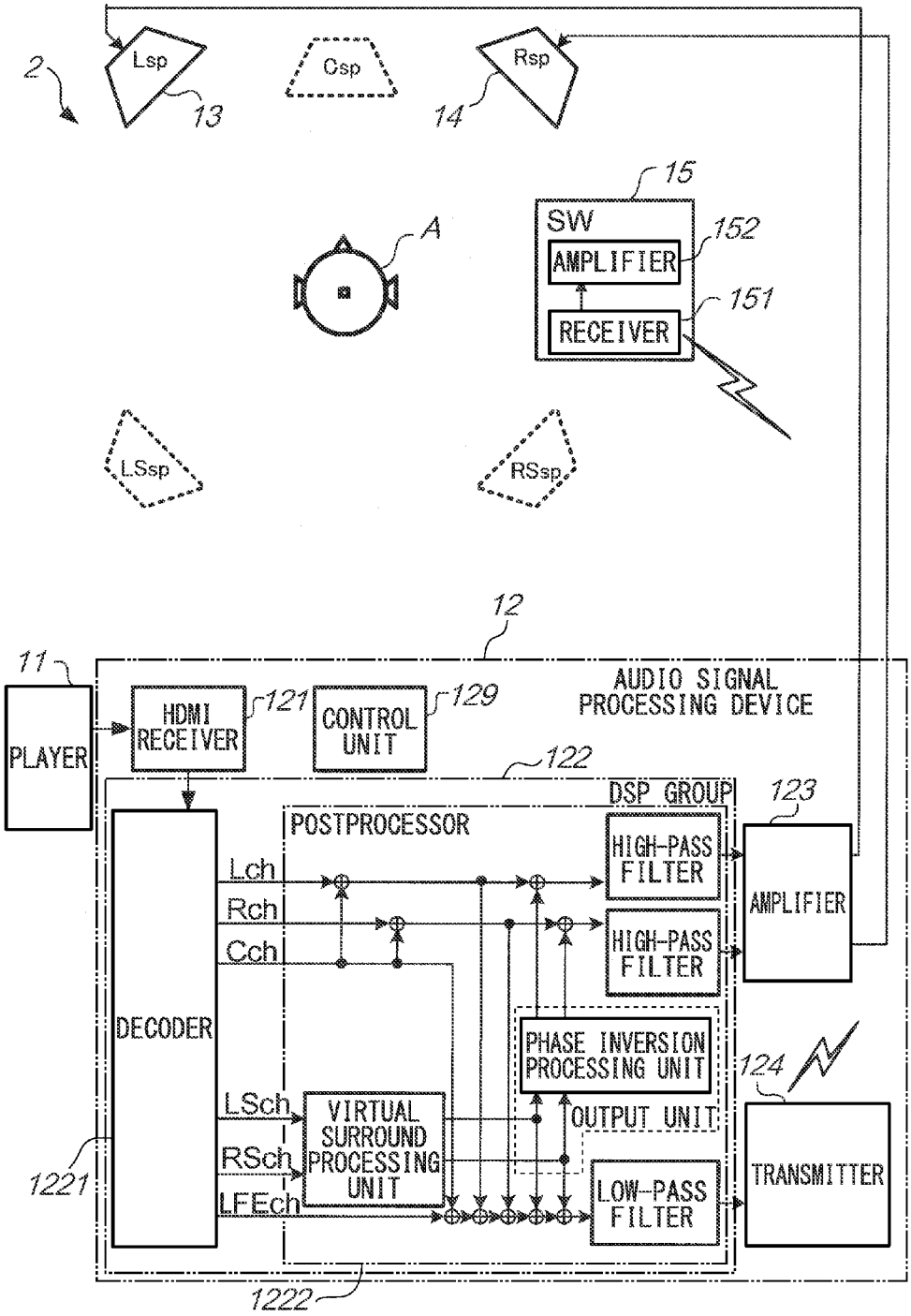
FIG. 2 is a diagram illustrating the configuration of a virtual surround system according to a second embodiment of the invention.

FIG. 2 is a diagram illustrating the configuration of a virtual surround system 2 according to a second embodiment of the invention. In the virtual surround system 2, the position of a phase inversion processing unit is different from the position of the phase inversion processing unit of the virtual surround system 1.

That is, the virtual surround system 1 is configured such that the audio signals of the LSch and the RSch for the Lsp 13 and the audio signals of the LSch and the RSch for the Rsp 14 generated by the virtual surround processing unit are subjected to the phase inversion for use in generation of the audio signals for the SW 15.

On the other hand, the virtual surround system 2 is configured such that the audio signals of the LSch and the RSch for the Lsp 13 and the audio signals of the LSch and the RSch for the Rsp 14 generated by the virtual surround processing unit are used without being subjected to the phase inversion in generation of the audio signals for the SW 15, and the audio signals of the LSch and the RSch for the Lsp 13 and the audio signals of the LSch and the RSch for the Rsp 14 generated by the virtual surround processing unit are subjected to the phase inversion for use.

Even in the virtual surround system 2, the phases of the sounds of the LSch and the RSch emitted from the Lsp 13 and the Rsp 14 and the components of the overlapping bands included in the sounds of the LSch and the RSch emitted from the SW 15 are opposite to each other. Therefore, the localization of the sounds of the channels for the virtual speakers is not pulled to the position of the subwoofer and is determined at the original positions of the virtual speakers.

[Third Embodiment]

Figure 3:
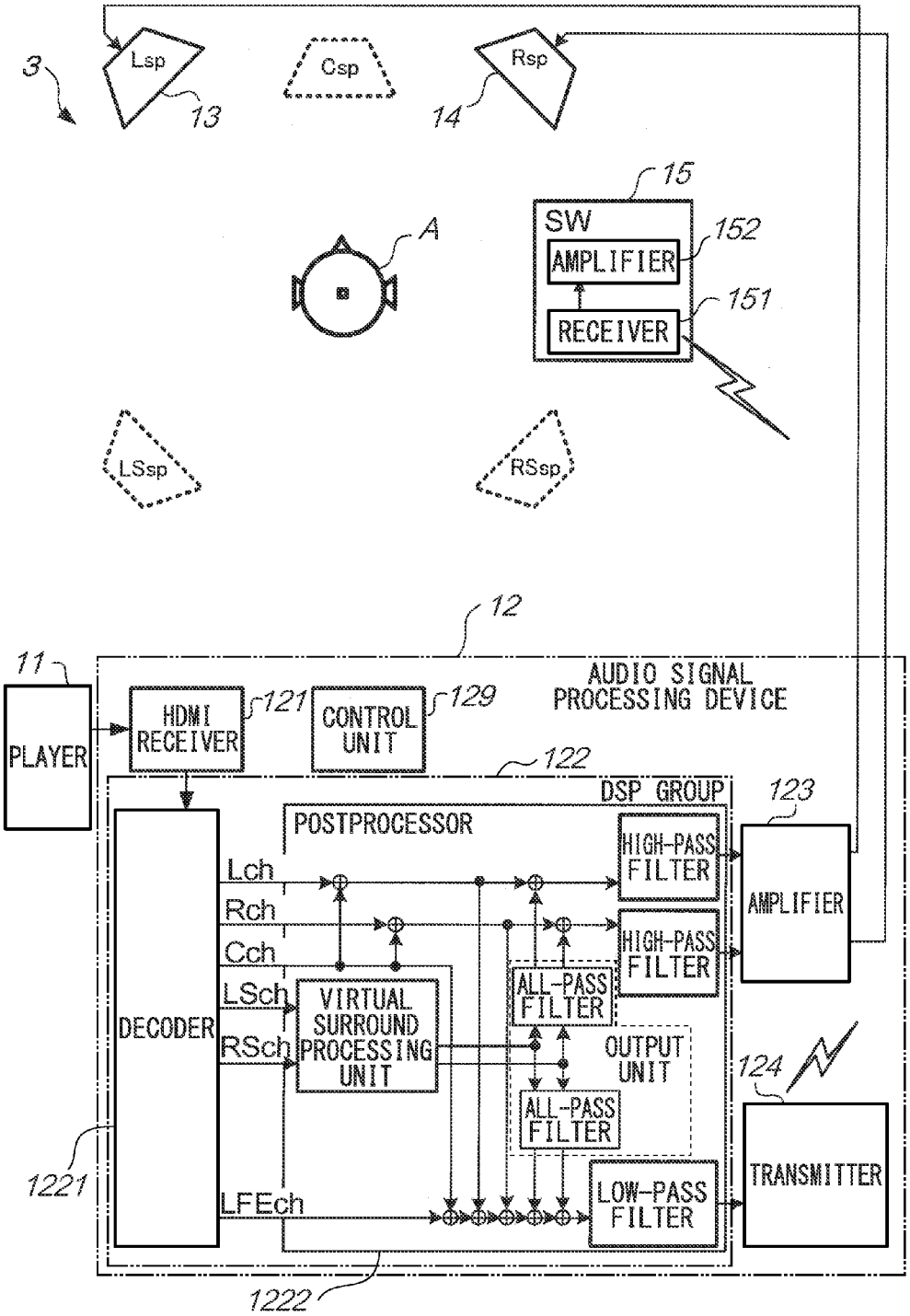
FIG. 3 is a diagram illustrating the configuration of a virtual surround system according to a third embodiment of the invention.

FIG. 3 is a diagram illustrating the configuration of a virtual surround system 3 according to a third embodiment of the invention. In the virtual surround system 3, all-pass filters are disposed instead of the phase inversion processing units at the position of the phase inversion processing unit of the virtual surround system 1 and the position of the phase inversion processing unit of the virtual surround system 2. The all-pass filters perform phase rotation of a predetermined angle on the audio signals generated by the virtual surround processing unit and used to generate the audio signals for the SW 15 and the audio signals generated by the virtual surround processing unit and used to generate the audio signals for the Lsp 13 and the Rsp 14 such that the phases of the audio signals are different from each other by 180 degrees.

Even in the virtual surround system 3, the phases of the sounds of the LSch and the RSch emitted from the Lsp 13 and the Rsp 14 and the sounds of the LSch and the RSch emitted from the SW 15 have the opposite relation. Therefore, the localization of the sounds of the channels for the virtual speakers is not pulled to the position of the subwoofer and is determined at the original positions of the virtual speakers.

[Fourth Embodiment]

Figure 4:
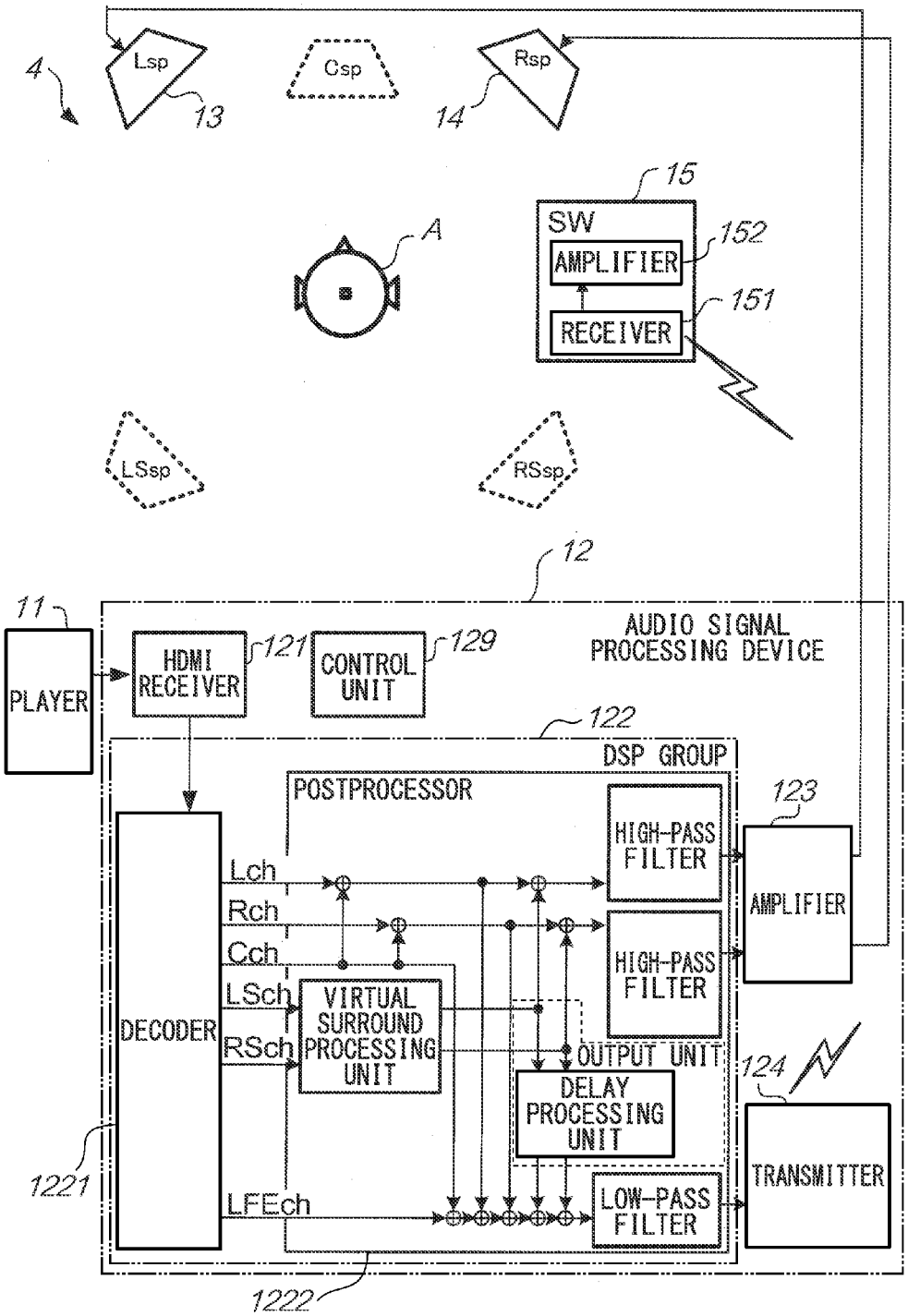
FIG. 4 is a diagram illustrating the configuration of a virtual surround system according to a fourth embodiment of the invention.

FIG. 4 is a diagram illustrating the configuration of a virtual surround system 4 according to a fourth embodiment of the invention. The virtual surround system 4 is configured such that a delay processing unit is disposed instead of the phase inversion processing unit at the position of the phase inversion processing unit of the virtual surround system 1. The delay processing unit adds a delay of about 10 milliseconds to 30 milliseconds to the audio signals output from the virtual surround processing unit and used to generate the audio signals for the SW 15.

When the delay is added by the delay processing unit, the timing at which the sounds of the LSch and the RSch included in the sounds emitted from the SW 15 reach the listener A is about 10 milliseconds to 30 milliseconds later than the timing at which the sounds of the LSch and the RSch included in the sounds emitted from the Lsp 13 and the Rsp 14 reach the listener A. Due to a psychological effect known as the precedence effect or the Haas effect, the listener A strongly perceives the localization of the sounds of the LSch and the RSch included in the sounds emitted from the precedent Lsp13 and Rsp 14 and does not perceive the localization of the sounds of the LSch and the RSch included in the sounds emitted from the SW 15 and subsequently arriving due to the short delay generally equal to or less than 30 milliseconds.

As a result, even in the virtual surround system 4, the localization of the sounds of the channels for the virtual speakers perceived by the listener is not pulled to the position of the subwoofer and is determined at the original positions of the virtual speakers.

[Other Modification Examples]

In the above-described embodiments, the virtual surround system in which the surround of 5.1 channels is virtually realized by a speaker system of 2.1 channels is used. However, the invention can be applied to a speaker system of various numbers of channels and a virtual surround system of various numbers of channels, as long as virtual surround is realized using a speaker system including one or more subwoofers. For example, generation of audio signals used to realize virtual surround of 9.1 channels using a speaker system of 5.1 channels may be realized in the virtual surround system according to the invention.

In the above-described first, second, and third embodiments, the disposition or the number of phase inversion processing units or all-pass filters may be modified in various ways, as long as the audio signals of the sounds are generated so that the phases of the sounds of the channels perceived as sounds emitted from the actual speakers and the virtual speakers by a listener are opposite to the phases of the sounds of the channels emitted from the subwoofer.

In this specification, when the phrase "opposite phases" is used, the phases may not be deviated by 180 degrees in a strict sense. The term "opposite phases" in this specification means a state in which the phases are sufficiently deviated to a degree that two sounds combined as the sound of the same channel and perceived by a listener are not perceived as the sound of the same channel when the phases are not deviated, and the localization of the sounds of the channels for the virtual speakers is not pulled to the position of a subwoofer.

In a third modification example of the above-described embodiment, the disposition of the delay processing unit may be modified in various ways, as long as the audio signals generated by the virtual surround processing unit and used to generate the audio signals for the SW 15 or the audio signals obtained by mixing the audio signals are subjected to the delay process so that the sound of the same channel emitted from the subwoofer reaches a listener later than the sounds of the channels perceived as the sounds emitted from the actual speakers and emitted from the virtual speakers by the listener. For example, the delay processing unit may be disposed at a position immediately in front of or behind the low-pass filter, instead of the position of the delay processing unit shown in FIG. 4.

In the above-described embodiments, the acoustic signals have been transmitted from the player 11 to the audio signal processing device 12 in conformity with the HDMI standard. However, another Digital Audio Interface Receiver (DIR) may be used as a DIR of the audio signal processing device 12. Further, when the player 11 outputs the analog audio signals, the audio signal processing device 12 may be configured to include an analog-to-digital (AD) converter and deliver audio signals converted to digital signals to the DSP group 122.

What is claimed is:

1. An audio signal processing device comprising:

a generation unit configured to generate n (where n is a natural number equal to or greater than 2) virtual process audio signals by processing at least one input audio signal so as to localize the input audio signal at a virtual position;

an output unit configured to output the n virtual process audio signals generated by the generation unit to n speakers as first output signals and to output the n virtual process audio signals generated by the generation unit to a subwoofer as second output signals;

a high-pass filter configured to attenuate a component of a frequency band lower than a predetermined cutoff frequency of the first output signals; and a low-pass filter configured to have the same order as the high-pass filter and to attenuate a component of a frequency band greater than the predetermined cutoff frequency of the second output signals, wherein the output unit is configured to output the first output signals and the second output signals so as to have mutually opposite phases.

2. The audio signal processing device according to claim 1, wherein the output unit includes a phase inversion processing unit configured to invert the phase of the first output signals or the second output signals so that the first output signals and the second output signals have opposite phases to each other.

3. The audio signal processing device according to claim 1, wherein the output unit includes an all-pass filter configured to rotate the phases of at least either of the first output signals and the second output signals so that the first output signals and the second output signals have opposite phases to each other.

4. The audio signal processing device according to claim 1, further comprising:

a first mixing unit configured to mix n real audio signals indicating n real sounds emitted from the n speakers with the n virtual process audio signals generated by the generation unit; and a second mixing unit configured to mix a real audio signal indicating a real sound emitted from the subwoofer with the n virtual process audio signals generated by the generation unit.

5. An audio signal processing device comprising:

a generation unit configured to generate n (where n is a natural number equal to or greater than 2) virtual process audio signals by processing at least one input audio signal so as to localize the input audio signal at a virtual position;

an output unit configured to output the n virtual process audio signals generated by the generation unit to n speakers as first output signals and to output the n virtual process audio signals generated by the generation unit to a subwoofer as second output signals;

a hiqh-pass filter configured to attenuate a component of a frequency band lower than a predetermined cutoff frequency of the first output signals; and a low-pass filter configured to have the same order as the high-pass filter and to attenuate a component of a frequency band greater than the predetermined cutoff frequency of the second output signals, wherein the second output signals are delayed by a predetermined time from a timing of the first output signals.

6. The audio signal processing device according to claim 5, further comprising:

a first mixing unit configured to mix n real audio signals indicating n real sounds emitted from the n speakers with the n virtual process audio signals generated by the generation unit; and a second mixing unit configured to mix a real audio signal indicating a real sound emitted from the subwoofer with the n virtual process audio signals generated by the generation unit.

* * * * *